United States Patent [19]

Sünderhauf

[11] 4,008,367

[45] Feb. 15, 1977

[54] POWER CABLE WITH PLASTIC INSULATION AND AN OUTER CONDUCTING LAYER

[75] Inventor: Heinz Sünderhauf, Berlin, Germany

[73] Assignee: Siemens Aktiengesellschaft, Munich, Germany

[22] Filed: June 23, 1975

[21] Appl. No.: 589,006

[30] Foreign Application Priority Data

June 24, 1974 Germany ..... 2430792

[52] U.S. Cl. ..... 174/107; 174/102 SC; 174/106 SC; 174/120 SC

[51] Int. Cl.[2] ..... H01B 7/22

[58] Field of Search ... 174/102 R, 102 SC, 105 SC, 174/106 SC, 107, 120 R, 120 SC, 120 SR, 110 PM

[56] References Cited

UNITED STATES PATENTS

| | | | |
|---|---|---|---|
| 3,748,369 | 7/1973 | Durakis et al. | 174/102 SC |
| 3,878,319 | 4/1975 | Wahl | 174/107 X |
| 3,885,085 | 5/1975 | Bahder et al. | 174/102 SC X |

*Primary Examiner*—Arthur T. Grimley
*Attorney, Agent, or Firm*—Kenyon & Kenyon Reilly Carr & Chapin

[57] ABSTRACT

In a power cable including a central conductor, an extruded inner conductor surrounding the conductor, an inner layer of extruded insulation surrounding the inner conducting layer, an extruded outer conducting layer surrounding the extruded insulation, a metal shield surrounding the outer conducting layer and an outer insulating sheath surrounding the metal shield, an intermediate insulating layer having a mechanical peel strength lower than that of the outer conducting layer and of the inner insulating layer is interposed between the inner insulating layer and the outer conducting layer to permit the outer insulating layer, metal shield and outer conducting layer to be easily peeled away from the inner insulating layer without damage to the outer conducting layer and without leaving a conducting residue on the inner insulating layer.

10 Claims, 1 Drawing Figure

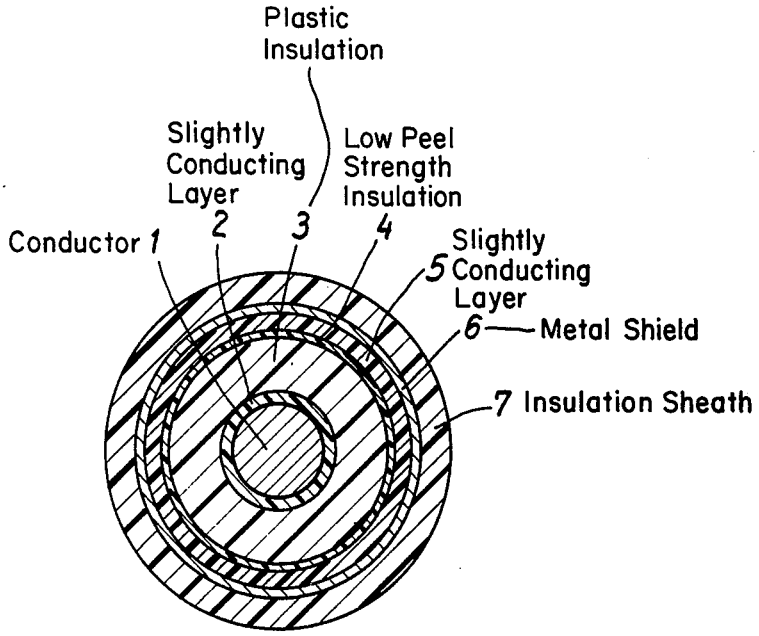
Plastic Insulation
Slightly Conducting Layer
Low Peel Strength Insulation
Conductor 1
2
3
4
5 Slightly Conducting Layer
6 Metal Shield
7 Insulation Sheath

POWER CABLE WITH PLASTIC INSULATION AND AN OUTER CONDUCTING LAYER

BACKGROUND OF THE INVENTION

This invention relates to power cables in general and more particularly to an improved power cable having plastic insulation and an outer conducting layer.

In power cables for use with transmission voltages of 10 kv or more, an electrically conducting or electrically slightly conducting layer is generally arranged between the conductor and the insulation along with such another such layer being arranged between the insulation and the metallic shield. The purpose of these layers is for controlling the electric field in the insulation. In particular, such layers are used in cables having an insulation made from a polyethylene base in which polyethylene or copolymerisates of ethylene may be present in the thermoplastic or in the interlinked state. In particular with cables having extruded plastic insulation the inner and outer conducting layers are applied using an extrusion process, in an attempt to obtain welding together of the conducting layers and the insulation. Generally, such is accomplished through application of the conducting layers and insulation in the same operation, for example through the use of extrusion heads arranged in tandem or through the use of a triple extrusion head.

When installing fittings in power cables having plastic insulation and having an outer conducting layer provided on top of the insulation it is important that the outer conducting layer be easily removable. In power cables using insulation of interlinked polyethylene, for example, a difficulty has existed in prior art cables in that the outer conducting layer which is applied over the insulation either adheres too weakly to the insulation and has a negative effect on the dielectric strength of the cable or is bonded too tightly to the insulation leading to difficulties in the installation of the cable, i.e. when removal of the outer conducting layer is necessary.

In view of these difficulties the need for an improved cable construction in which dielectric strength is maintained but in which the outer conducting layer can be easily and reliably removed becomes evident.

SUMMARY OF THE INVENTION

The present invention provides such a power cable in which the extruded plastic insulation and extruded outer conducting layer have a good dielectric welding therebetween and in which, at the same time, ease of stripping the outer conducting layer from the insulating layer to install fittings is obtained.

The present invention solves this problem by arranging, between the insulation and the conducting layer, an intermediate layer having a mechanical strength which is lower than the mechanical strength of the insulation and lower than the mechanical strength of the conducting layer. When the outer conducting layer must be removed in a power cable of such a design to install fittings such as terminations or conducting sleeves, the conducting layer can be easily stripped off with the separation between the outer conducting layer and insulation taking place in the intermediate layer provided according to the present invention. This construction insures easy stripping of the outer conducting layer and at the same time insures that the outer conducting layer is removed without residue on the insulation so that the need for re-work of the conductor insulation during installation is eliminated.

The basis of the invention lies in the use of an intermediate layer of mechanical strength which is lower than both that of the insulation and the outer conducting layer. Preferably the mechanical strength of the intermediate layer will be less than 60% of the mechanical strength of the insulation and outer conducting layer in order to insure reliable removal of the conducting layer. Since the tensile strength of common insulating and conducting layers is between 10 and 15 N/cm$^2$, the tensile strength of the intermediate layer should be about 5 N/cm$^2$. The thickness of the intermediate layer should be approximately equal to the thickness of the conducting layer and preferably will be between 0.1 and 0.3 mm.

It is advantageous that the materials used for the intermediate layer according to the present invention can also be extruded. In particular plastics, preferably low-molecular olefin polymerisate such as polyethylene, atactic polypropylene or polymerisate mixtures with ethylene as one component are useful. Also suitable are high molecular polybutenes, which may be sprayed onto the insulation if desired. The mechanical strength of these plastics can be adjusted within wide limits through the choice of molecular weight or by adding inert mineral fillers. Suitable fillers which may be used are, for example, chalk, kaolin, chalk flint, silicon dioxide and the like.

The intermediate layer can also employ materials such as insulating varnish or insulating adhesives, the mechanical strength of which likewise insures separation between the conductor and the insulation in the region of the intermediate layer when the outer conducting layer is stripped off. Suitable varnishes which may be used included synthetic resin varnishes with an acrylic resin base while possible adhesives include synthetic rubber base such as polychloroprene or low-molecular styrenebutadiene rubber. The use of insulating varnishes or insulating adhesives is particularly attractive where the insulation and outer conducting layer are applied in a tandem extrusion process, i.e., using extrusion heads arranged one behind the other.

An extruded intermediate layer can be applied such that the inner conducting layer and the insulation are applied in a first extrusion head and the intermediate layer and the outer conducting layer in a second extrusion head arranged immediately behind the first one. Alternatively, the inner conducting layer may be applied by itself and the insulation, the intermediate layer and the outer conducting layer applied using a triple extrusion head. It is also possible to apply all four layers using a quadruple extrusion head. In whatever manner the application is carried out dielectric welding, which is necessary for the dielectric strength of the power cable, between the inner conducting layer and the insulation as well as between the insulation layer, the intermediate layer and the outer conducting layer is obtained.

One particularly simple manner of applying the intermediate layer which eases the manufacturing process is to apply the material of the intermediate layer in a continuous operation using a washing process with subsequent passage through a wiper nozzle.

BRIEF DESCRIPTION OF THE DRAWINGS

The single FIGURE is a cross-sectional view of a single core power cable according to the present invention.

DESCRIPTION OF THE PREFERRED EMBODIMENT

The single FIGURE illustrates a cross-sectional view of a single core power cable made according to the present invention. It has a conductor composed of wires to which an inner conducting layer 2 of slightly electrically conducting ethylene copolymerisate was first applied. On top of this inner conducting layer 2, extruded insulation 3 of polyethylene was applied and over this insulation an intermediate layer 4 according to the present invention was applied. On top of the intermediate layer 4 the outer conducting layer 5 also of a slightly electrically conducting ethylene copolymerisate was applied. Over the outer conducting layer 5 a copper shield 6 was applied which in turn was surrounded by a sheath 7 of polyvinyl chloride.

The intermediate layer 4 was made of a polyethylene having a mechanical strength obtained through suitable choice of molecular weight and configuration which was about 50 percent lower than the mechanical strength of the insulation 3 and outer conducting layer 5.

As noted above, suitable materials for the intermediate layer 4 include plastic materials with an olifin polymerisate base, applied either by washing or extrusion, which can have added thereto inert mineral fillers such as chalk, chalk flint, kaolin, silicon dioxide and the like. It is also possible to use layers of insulating varnish or insulating adhesive. As further noted above, it is preferable that the wall thickness of the intermediate layer 4 be between 0.1 and 0.3 mm.

Thus an improved power cable which permits easier stripping of the outer conducting layer has been described. Although a specific embodiment has been illustrated and described, it will be obvious to those skilled in the art that various modifications may be made without departing from the spirit of the invention which is intended to be limited solely by the appended claims.

What is claimed is:

1. In a power cable including a central conductor, an extruded inner conducting layer surrounding said conductor, an inner layer of extruded insulation surrounding said inner conducting layer, an extruded outer conducting layer surrounding said insulating layer, a metal shield surrounding said outer conducting layer, and an outer insulating layer surrounding said metal shield, an improved construction permitting said outer insulating layer, metal shield and outer conducting layer to be peeled away from said inner insulating layer without damage to said outer conducting layer, comprising an intermediate insulating layer having a mechanical peel strength lower than the mechanical peel strength of the outer conducting layer and of said inner insulating layer, said intermediate insulating layer interposed between said inner insulating layer and said extruded outer conducting layer.

2. A power cable according to claim 1 wherein the mechanical strength of said intermediate layer is less than 60% of the mechanical strength of the plastic insulation and outer conducting layer.

3. A power cable according to claim 1 wherein said intermediate layer consists of a plastic material with an olifin polymerisate base.

4. A power cable according to claim 3 wherein said olifin polymerisate base has mixed therewith at least one of the group of inert mineral fillers consisting of chalk, chalk flint, kaolin, and silicon dioxide.

5. A power cable according to claim 2 wherein said intermediate layer is one of the group consisting of an insulating varnish and an insulating adhesive.

6. A power cable according to claim 5 wherein the wall thickness of said intermediate layer is between 0.1 and 0.3 mm.

7. A power cable according to claim 1 wherein said intermediate layer consists of a plastic material with an olifin polymerisate base.

8. A power cable according to claim 1 wherein said olifin polymerisate base has mixed therewith at least one of the group of inert mineral fillers consisting of chalk, chalk flint, kaolin, and silicon dioxide.

9. A power cable according to claim 1 wherein said intermediate layer is one of the group consisting of an insulating varnish and an insulating adhesive.

10. A power cable according to claim 1 wherein the wall thickness of said intermediate layer is between 0.1 and 0.3 mm.

* * * * *